US008003178B2

(12) United States Patent
Kim et al.

(10) Patent No.: US 8,003,178 B2
(45) **Date of Patent: *Aug. 23, 2011**

(54) CONTAINER WITH IMPROVED RELEASE PROPERTIES

(75) Inventors: Dennis Ann Kim, Palatine, IL (US); Mia Rivard, Montreal (CA); Jeffrey Donald Edgerton, Chicago, IL (US)

(73) Assignee: Kraft Foods Global Brands LLC, Northfield, IL (US)

( * ) Notice: Subject to any disclaimer, the term of this patent is extended or adjusted under 35 U.S.C. 154(b) by 1134 days.

This patent is subject to a terminal disclaimer.

(21) Appl. No.: 11/748,815

(22) Filed: May 15, 2007

(65) Prior Publication Data

US 2008/0283483 A1 Nov. 20, 2008

(51) Int. Cl.
*B29D 22/00* (2006.01)

(52) U.S. Cl. ..... 428/35.7

(58) Field of Classification Search ..... 428/35.7; 220/62.13, 62.12, 62.22; 215/12.2, 12.1
See application file for complete search history.

(56) References Cited

U.S. PATENT DOCUMENTS

| | | | | |
|---|---|---|---|---|
| 2,120,640 | A * | 6/1938 | Craemer | 426/130 |
| 2,504,482 | A | 4/1950 | Goldman | |
| 2,611,499 | A * | 9/1952 | Mayer | 215/6 |
| 2,832,701 | A | 4/1958 | Miskel | |
| 3,498,799 | A | 3/1970 | Geyer | |
| 3,688,682 | A | 9/1972 | Good | |
| 4,393,106 | A | 7/1983 | Maruhashi et al. | |
| 4,451,512 | A | 5/1984 | Yazaki et al. | |
| 4,606,942 | A | 8/1986 | Shriver et al. | |
| 4,883,198 | A | 11/1989 | Manska | |
| 5,096,746 | A | 3/1992 | Strizki | |
| 5,186,979 | A | 2/1993 | Ballenger, Jr. et al. | |
| 5,378,510 | A | 1/1995 | Thomas et al. | |
| 5,494,502 | A | 2/1996 | DeLong | |
| 5,660,691 | A * | 8/1997 | Barnicki et al. | 203/72 |
| 5,707,691 | A | 1/1998 | Plester et al. | |
| 6,099,923 | A | 8/2000 | Kitei | |
| 6,247,603 | B1 | 6/2001 | Farrell et al. | |
| 6,599,594 | B1 | 7/2003 | Walther et al. | |
| 6,632,493 | B1 | 10/2003 | Hildebrand, IV et al. | |
| 6,673,753 | B2 | 1/2004 | Person Hei et al. | |
| 2003/0121793 | A1 | 7/2003 | Groeger et al. | |

(Continued)

FOREIGN PATENT DOCUMENTS

FR 2507449 A 12/1982

(Continued)

OTHER PUBLICATIONS

"American Iron and Steel Institute says Steel Can Coatings Undergoing Major Changes," Good Packaging, vol. 43, No. 11, Nov. 1982, pp. 14-15, 25.

(Continued)

*Primary Examiner* — Rena L Dye
*Assistant Examiner* — James Yager
(74) *Attorney, Agent, or Firm* — Fitch, Even, Tabin & Flannery

(57) ABSTRACT

A container that has improved release properties for a viscous material configured to minimize residual material remaining in the container upon normal use thereof and also generally maintains the physical stability of a material in the container. The container includes a coating applied to a portion of the inner surfaces thereof that is effective to provide the improved release properties.

30 Claims, 8 Drawing Sheets

U.S. PATENT DOCUMENTS

| | | | | |
|---|---|---|---|---|
| 2004/0115332 | A1* | 6/2004 | Teran et al. | 426/609 |
| 2005/0037110 | A1* | 2/2005 | Windhab et al. | 426/100 |
| 2005/0127105 | A1* | 6/2005 | Kay | 222/211 |
| 2008/0286480 | A1 | 11/2008 | Kim et al. | |

FOREIGN PATENT DOCUMENTS

| | | | |
|---|---|---|---|
| FR | 2851940 | A | 9/2004 |
| JP | 2000-289783 | A2 | 10/2000 |
| WO | 9843886 | A | 10/1998 |
| WO | 9847773 | A | 10/1998 |
| WO | 0151222 | A | 7/2001 |

OTHER PUBLICATIONS

"New Packaging, Vitamin E Containing Oil," Revue de I'Industrie Agro Alimentaire, vol. 421, 1989, p. 24.

"Internal Siliconisation," Verpackungs-Rundschau, vol. 51, No. 10, 2000, pp. 62, 64, Abstract.

A. Schaefer et al., "Screening of Lubricants From Food Packaging—Validation of Group-Specific NP-HPLC Separation With ELS Detection and its Application," Lebensmittelchemie, vol. 56, No. 6, 2002, pp. 142-144.

European Search Report, EP08155979, mail date Aug. 22, 2008.

* cited by examiner

CONTAINER WITH IMPROVED RELEASE PROPERTIES

FIELD

The invention generally relates to containers and, more particularly, to containers effective to facilitate improved product release and stability.

BACKGROUND

Viscous products, such as comestibles, paints, toothpastes, lotions, cosmetics, or cleaning products to suggest but a few are often stored and dispensed from a container, jar, tube, or other packaging with a relatively narrow dispensing opening or mouth. Due to the viscous nature of these products, a residual amount may be left in the bottom or corners of the container during normal use. In many cases, due to the particular geometry of the container, the consumer is unable to retrieve such residual product even with the use of an extra utensil to scrape the inside of the container. The container may have a small dispensing nozzle that is not sized for receipt of a utensil or, even if a utensil can be inserted through the mouth, the container may have regions that cannot be accessed by the utensil. This unused, residual product often remains in the container and is disposed of along with the container.

The container can be redesigned to improve product evacuation, but such redesigns can be costly and may not result in a significant decrease in the amount of residual product left in the container after normal use. For example, product release from a container can, in some cases, be improved by modifying the container shape or geometry to have shoulder portions that minimize the amount of residual product that remains in such areas. However, as indicated above, redesigning a container shape is costly because new molds are typically required.

Other attempts to improve product release involve modifying the inner surface of the containers. The entire container inner surface may be corona or plasma treated to modify the surface energy/wetting tension ability of the packaging material or a release coating may be applied to the entire inner surface of the container to provide a surface that the material may more easily release from. For example, U.S. Pat. No. 6,247,603 B1 discloses coating either soybean oil or olive oil to the entire inner surfaces of a container. Other references, such as U.S. Pat. Nos. 2,832,701; 2,504,482; and 6,599,594 also suggest applying various coatings to the entire inner surfaces of containers. These methods have shortcomings that may detrimentally affect the visual appearance of the product and/or potentially degrade product quality within the container during shipment. The shortcomings may be especially apparent when the viscous material is an emulsion or aerated product or when the container is transparent so that the product can be viewed by the consumer.

It has been discovered that a surface treatment or coating applied to the entire inner surface of a container may affect the stability of some viscous materials. For example, when the viscous material is an emulsion or aerated material, the surface treatment or release coating applied to the entire inner surface of the container can result in oiling-off or overrun collapse of the product. It is believed that such instability results from the viscous material not being able to stick to the container walls adjacent a product/container interface at the top surface of the material because of the coating or surface treatment. As a result, during shipment of the container, the material adjacent this interface moves or slides about the container wall. The resulting mechanical energy from this product motion may cause the emulsion to separate, forming a layer of oil on the surface of the material, or may cause a portion of the overrun to collapse, resulting in a decrease in product volume. Such instability is most apparent after vibration of the container encountered during product shipping.

Existing coatings also have other shortcomings. For example, the '603 patent discloses a coating of either soybean oil or olive oil. These oils have undesired physical characteristics that render them less desirable for use as a release coating—especially when the coating is applied to a clear or transparent container. These oils typically have a yellowish and/or greenish tint. Therefore, when coated on the inner surfaces of a transparent container, the soybean or olive oil coatings will potentially alter the physical appearance of the product within the container. For example, if the product is a generally white mayonnaise-type material, toothpaste, or lotion, then a yellowish or greenish oil coating on the inner surfaces of a transparent container may impart a color change to the white product. Such a change in appearance may render the product undesirable to a consumer because they may not associate such off-colors with the product in the container. Soybean and olive oil also have a viscosity profile that substantially changes between room and refrigeration temperatures, such that evacuation of viscous materials that have been stored in refrigerators may be substantially reduced.

Coatings that use soybean oil or olive oil are also subject to oxidation. These oils comprise substantial amounts of unsaturated fatty acids that tend to be unstable and prone to oxidation. Soybean and olive oil, for example, may contain greater than 70 percent unsaturated fatty acids. Once the container is opened, these soybean and olive oil coatings may become rancid over time if not properly stored due to oxidation. Such chemical changes to the coating may also create the perception to a consumer that the viscous material in the container is no longer usable.

A container having the entire inner surfaces coated may also be perceived by a consumer as being less desirable because such a container would appear to have less product than a traditional, uncoated container—even if filled with the same amount or volume of product. With the traditional, uncoated container holding a viscous material, the container generally appears completely full even though the product volume may be slightly less than a full container. With the uncoated container, the viscous material is allowed to generally adhere to the container walls and, therefore, the container appears to a consumer to be completely full without any unsightly bubbles or void areas of the product being visible. On the other hand, with the coating techniques of the prior art, a container completely coated or surface treated on its inner walls to form a release surface may appear less full than a corresponding uncoated container or have unwanted void areas or bubbles because the viscous material is no longer capable of adhering to the container inner surfaces and slides off from such surfaces. As a result, visible empty areas may be present in various portions of the container depending on the container's orientation. Such a container may be less desirable to the consumer.

Accordingly, there is a desire for a container that is effective to facilitate improved product release that also generally maintains product stability.

SUMMARY

A container is provided that is configured for improved product release and usage efficiency of a viscous material. In one form, the container includes a first or holding portion having at least a side wall defining a cavity for containing the viscous material and an outlet portion defining an opening into the cavity for dispensing the viscous material. Preferably, the container has both a side wall and a bottom wall to define the cavity. Each of the side wall, the bottom wall, the outlet portion has inner surfaces.

In one embodiment, the container has a coating selected and applied in an amount effective to maintain product stability and provide increased evacuation of a viscous material from the container at both room and refrigeration temperatures. The coating is applied to a predetermined coverage area that is preferably only a portion of the side wall inner surface and, most preferably, a portion of the side wall inner surface and the bottom wall inner surface. In one aspect, the predetermined coverage area includes about 70 to about 90 percent of the container side wall. In another aspect, the outlet portions of the container are substantially free of the coating. Therefore, with the coating applied to only portions of the container inner surfaces, the viscous material generally does not adhere to these coated portions but generally adheres to the uncoated portions.

With such coating application, it has been discovered that the containers described herein exhibit enhanced product stability (i.e., little or no oiling off or overrun collapse prior to consumer use), but still permit better evacuation performance than prior containers at both room and refrigeration temperatures. For example, the containers herein maintain the physical stability of the viscous material contained therein, but still are effective to dispense greater than about 90 percent, preferably greater than about 95 percent, and most preferably greater than about 98 percent of the viscous material upon normal use thereof at both temperature ranges. Such levels of product evacuation are achieved even with the coating applied only to a portion of the container side wall as described above.

In one form, the container is at least about 5 fluid ounces (preferably at least about 18 fluid ounces or at least about 24 fluid ounces) and generally has a height greater than its width. The container also preferably includes a transition portion between the cavity and the outlet portions, such as a shoulder extending between the relatively narrow outlet portion and the generally larger cavity of the holding portion. Preferably, the transition portion is also substantially free of the coating such that the viscous material is permitted to adhere to an inner surface of the transition portion. While one form of the container is described above, it will be appreciated that other forms of the container may also be used, such as tubes, jars, bottles, and the like that are both squeezable, flexible, rigid, and the like.

In one embodiment, the coating is a saturated and substantially colorless lipid composition having a viscosity of less than about 25 cp at room temperature and a viscosity of less than about 60 cp at refrigeration temperatures. For example, a preferred coating is a lipid composition comprising glycerol esters having about 70 to about 100 percent medium chain fatty acid residues between 6 and 12 carbon atoms inclusive. Such coating material provides improved product release and product usage efficiency due to its low viscosity at both room and refrigeration temperatures as compared to prior coatings (i.e., olive oil and soybean oil have viscosities generally between about 50 to about 60 cp at room temperature and between about 120 and about 560 cp at refrigeration temperatures). Because the preferred coatings are substantially colorless, they also do not substantially alter the appearance of the material within the container. Therefore, the coatings described herein may be used with light colored substances even in a clear or transparent container with little or no effect on the material's appearance.

Preferably, the container has about 3.5 mg/in$^2$ or less of the coating applied to the predetermined coverage area in the container. For example, for a container of about 18 to about 24 fluid ounces, about 0.15 to about 0.18 grams of the coating is applied to the predetermined coverage area. It will be appreciated, however, that more or less coating may be applied depending on the particular size and geometry of the container and on the desired size of the predetermined coverage area. In other embodiments, the container has a coating applied to the predetermined coverage area having a thickness of about 0.003 inches or less. Such amounts of the above described coatings are generally effective to provide improved product evacuation of a viscous material over prior containers even when only applied to a portion of the container inner surfaces as described above.

In another forms, the coating may also comprise other suitable release-type materials applied to a portion of the container side wall. For example, the coating may also be a vegetable oil blended with a lipid soluble antioxidant. Suitable antioxidants may include TBHQ, BHT, BHA, gallates, tocopherols, tocotrienols, ascorbyl palmiate, and mixtures thereof. Other coatings may include mixtures of soybean or canola oil together with small amounts of lecithin and food grade alcohols. Such coatings are expected to provide similar results when applied to a portion of the container side walls, but are less desired in some cases because they may impart a slight color change to the product or have other potential unwanted effects on the viscous material in the container.

There is also provided a method of filling a container, such as a flexible, transparent container, having an interior and a dispensing opening at one end thereof effective to facilitate improved product release and usage efficiency from the container without changing the appearance of the filled container. In one form, the method includes the steps of (1) coating a predetermined coverage area (such as about 70 to about 90 percent of the container sidewall height) of the interior of the container up to a first elevation with a lipid composition; and (2) filling the container with a viscous material to a second elevation above the first elevation. Preferably, the predetermined coverage area is sprayed with the lipid composition.

In a preferred embodiment, the method further includes the step of inserting a spray nozzle a predetermined distance (i.e., about 0.125 to about 1.5 inches) into the container to dispense the lipid composition onto the predetermined coverage area. To achieve the coating substantially within the predetermined coverage area and to minimize the coating to other areas, the spray nozzle has a particular spray pattern configured to spray the coating onto the predetermined coverage area with substantially no coating outside this area. For example, one form of the spray nozzle includes a spray tip configured to project a spray field less than about 60°, preferably between about 15° to about 50°, and most preferably about 45° to provide the coating onto the predetermined coverage area with minimal, and essentially no overspray.

In other aspects, the method may also include a step of coating the predetermined coverage area under a slight negative pressure (i.e., achieved via a reverse airflow of about 500 to about 1000 cfm and, preferably, about 800 to about 1000 cfm; however, other methods to achieve negative pressures may also be employed), which is generally sufficient to remove any residual or random coating from the interior of the container. This negative pressure helps minimize the lipid composition from accumulating onto unwanted areas.

DETAILED DESCRIPTION

Figure 1:
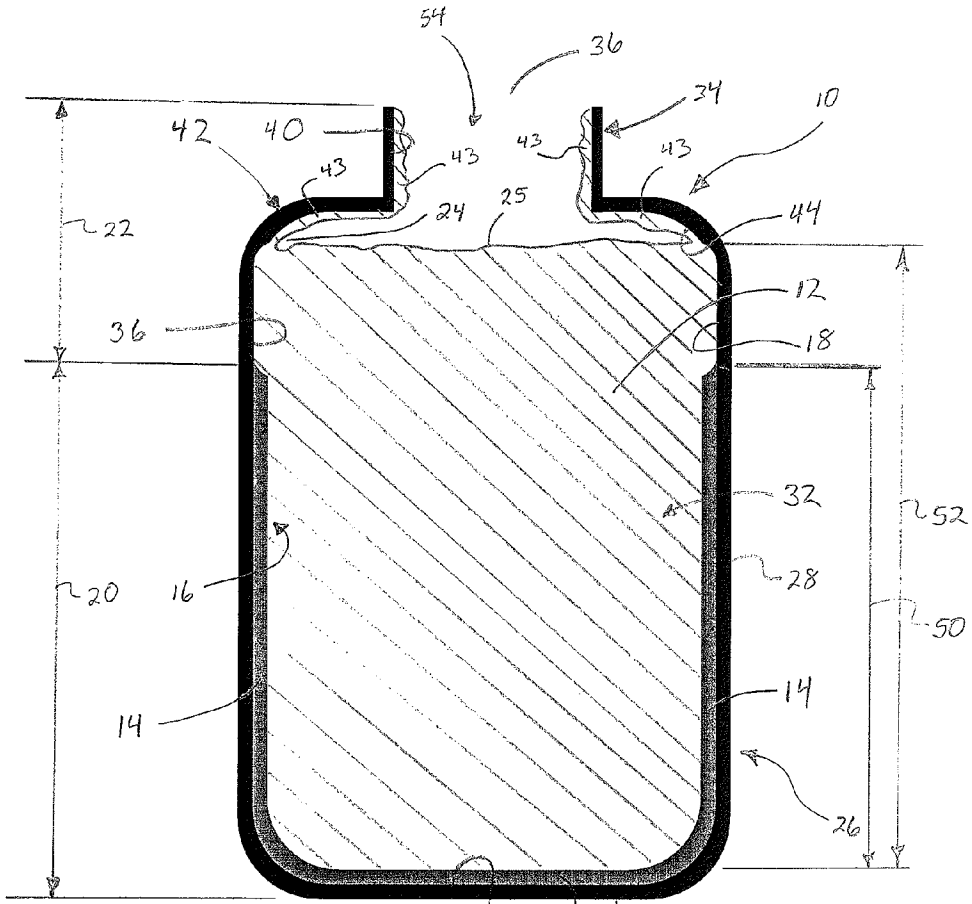
FIG. 1 is a schematic view of a container having a coating on a portion of a side wall inner surface.

Referring to FIG. 1, a container 10 is illustrated for holding and dispensing a viscous material 12. The container 10 provides improved product release at both room and refrigeration temperatures without substantially impacting the appearance or physical stability of the viscous material 12 in the container prior to consumer use thereof. Such enhancements are generally achieved by selecting a coating 14 and applying that coating in effective amounts to inner surfaces of the container 10 to maintain product stability and to provide increased product evacuation. Preferably, the coating is applied to a predetermined coverage area 16 that is less than the entire inner surface area of the container 10. In this manner, only a portion of inner surfaces 18 of the container 10 have the coating 14 thereon. In other words, the container inner surface 18 preferably has a first portion 20 with the coating 14 thereon, and a second portion 22 with little or substantially no coating thereon.

The coating 14 applied to the container inner surfaces 18 in such a manner may provide several advantages over prior containers. For example, the coating 14 applied to the predetermined coverage area 16, which is less than the entire inner surface area, may generally maintain the physical stability of the material 12 at an interface 24 between a material upper surface 25 and the container 10 during shipment and other movements of the container prior to consumer use. That is, with a coating 14 applied to the predetermined coverage area 16, it has been discovered that in some cases where the viscous material 12 is an emulsion or aerated product, there is minimal and, preferably, no oiling-off or product collapse prior to consumer use.

In addition, even though the coating 14 is only applied to a portion of the container inner surface 18, the preferred coatings herein have properties to provide enhanced product evacuations over a wider temperature range than prior coated containers. Preferred coatings 14 provide improved product evacuation at both room and refrigeration temperatures. The containers herein evacuate greater than 90 percent, preferably greater than 95 percent, and most preferably, greater than 98 percent of the viscous material at both temperatures ranges independent of container geometry. The preferred coatings 14 are also substantially clear so that they impart minimal and, preferably, no appearance changes to any material within the container. As a result, the coating 14 can even be applied to transparent containers so that an expected consumer appearance of the viscous material 12 is generally maintained.

For purposes herein, a "viscous" material, substance, or product generally refers to a material having a viscosity greater than about 5,000 cp, preferably greater than about 100,000 cp, and most preferably greater than about 200,000 cp. Viscosity is measured using a Brookfield viscometer with a spindle appropriate for the material at room temperatures; however, other methods and equipment may also be used to determine viscosity as needed. Examples of viscous products suitable for use in the containers described herein, include but are not limited to, comestibles (e.g., mayonnaise, mayonnaise-type products, catsup, mustard, salad dressings, sandwich spreads, sauces, marinades, cheese, cheese products, peanut butter, spreads, pastes, jams, jellies, honey, syrups to suggest but a few), paints, coatings, dyes, cosmetics, lotions, pastes, ointments, pharmaceuticals, adhesives, and the like. There are, of course, many other examples of viscous materials suitable for use in the containers described herein. "Room temperature" is intended to mean about 20 to about 25° C. "Refrigeration temperature" is intended to mean about −5 to about 10° C. As also used herein, "normal use" of the container means evacuation of the viscous product through the container opening without using a supplementary utensil, such as a knife or spoon, to scrape interior surfaces of the container to remove residual product. Normal use generally involves dispensing the viscous product from the container by pouring, squeezing, shaking, hitting, pounding, or any combination of such actions. As also used herein, "substantially free of the coating" means the coating is not intentionally applied to such container areas and only includes negligible or trace amounts of the coating, such as less than about 0.3 $mg/in^2$.

Referring again to FIG. 1, the container 10 generally includes a first or material holding portion 26 having a side wall 28 and a bottom wall 30 defining a cavity 32 for containing the viscous material 12 therein. The container 10 also includes an outlet portion 34 defining an opening 36 into the cavity 32. The outlet portion 34 is for dispensing the viscous product from the cavity 32. Each of the side wall 28, the bottom wall 30, and the outlet portion 34 has an inner surface 36, 38, and 40, respectively. The container 10 also preferably includes a transition portion or shoulder region 42, which extends between the generally wider holding portion 26 and the generally narrower outlet portion 34. The transition portion 42 also includes an inner surface 44.

It should be appreciated that the figures only schematically illustrate the container 10, and the container 10 may be formed from a variety of different shapes, sizes, configurations, and materials, including but not limited to jars, tubes, squeeze bottles, and the like. The container 10 is preferably formed from a plastic material, such as PET, but may also be formed from other plastics, glass, films, foils, and other materials suitable for forming containers as well as combinations thereof. The container may include a dispensing opening about 1 to about 5 inches wide onto which a cap or cover may be applied. The cap or cover may further include a small dispensing aperture so that the viscous material may be poured through the small aperture by tilting the container or may be squirted out through the aperture by squeezing the sides of the container. Alternatively, the dispensing opening may also include a hand-pump. The container 10 is also generically illustrated with the dispensing outlet 34 at the top of the container 10 (i.e., a cap up configuration). Alternatively, the container 10 may also include a configuration with the dispensing outlet 34 at the bottom of the container 10, such as a container configuration that is adapted to sit on a cover (not shown) enclosing the dispensing outlet (i.e., a cap down configuration). The concepts described herein are generally applicable independent of a particular container configuration or geometry.

The coating 14 is applied to the predetermined coverage area 16 of the container inner surface 18. Preferably, this predetermined coverage area 16 is a portion 20 of the side wall inner surface 36 and, preferably, the side wall portion 20 and the bottom wall inner surface 38. In one form, it is preferred that the first coated portion 20 include about 70 to about 90 percent of the side wall inner surface 36 and substantially all of the bottom wall inner surface 38. In this configuration, an uncoated second portion 22 is formed that generally includes the areas adjacent the container outlet 36, such as the inner surfaces of the transition portion 42 and the outlet portion 34. In other words, it is preferred that the inner surface 44 of the transition portion 42 and the inner surface 40 of the outlet portion 34 are substantially free of the coating. As discussed above, substantially free of the coating means these inner surfaces may have negligible or trace amounts of coating. In one example, a suitable container has a height of about 7 inches, a width of about 3 to about 4 inches, and a depth of about 1.5 to about 2.5 inches. Such a container preferably has a predetermined coverage area 16 of about 48 to about 92 square inches that covers the bottom surface 38 and about 70 to about 90 percent of each side surface (i.e., left and right) and about 70 to about 90 percent of each of the front and back faces of the container.

By applying the coating 14 to substantially only the predetermined coverage area 16, which is less than the entire container inner surface area, the container 10 provides an environment that generally does not effect the stability of the material 12 in the container (i.e., such as emulsion stability or overrun stability). Because the container 10 has the portions 22 adjacent the outlet substantially free of the coating, a layer of viscous material 43 (FIG. 1) is permitted to generally adhere to these uncoated inner surfaces (i.e., surfaces 44 and 40). As a result, when the container is filled to a level extending beyond the predetermined coverage area 16 (i.e., product fill distance 52 in FIG. 1), it has been discovered there is a more stable interface 24 formed between the viscous material 12 and the container 10. While not wishing to be limited by theory, it is believed that providing a surface that the viscous material 12 can generally adhere allows less movement of the material at the interface 24 during any vibration or motion of the container (such as during shipment or other movement prior to consumer use). Less movement of the material at this interface results in less mechanical energy imparted to the product, which permits the product to generally remain in its desired physical form, such as emulsified or aerated. For purposes herein "stability" or "physical stability" of the viscous material generally refers to little or substantially no oiling-off or overrun collapse of the viscous product.

In one form, the coating 14 is a lipid composition that includes a mixture of glycerol esters having a predetermined composition of fatty acid residues. Preferably, the coating 14 is a saturated and substantially clear lipid composition that has a viscosity less than about 25 cp, and preferably a viscosity between about 15 and about 25 cp at room temperature. The lipid composition also preferably has a viscosity at refrigeration temperatures of less than about 60 cp. While not wishing to be limited by theory, it is believed that such low viscosity enables the coating 14 to provide the improved product evacuation even when applied to less than the inner entire surface area of the container. A coating with such low viscosity is also advantageous because it is easier to apply a uniform application to the predetermined coverage area through atomization or spray coating techniques. Preferably, the coating has the appearance of water, such that when applied to the container it generally does not alter the appearance of the viscous product in the container. Because the coating comprises a saturated lipid composition, it is also generally stable to oxidation.

One example of a preferred coating is a medium chain triglyceride mixture formed from triglycerides having between about 70 and about 100 percent fatty acid residues with between 6 and 12 carbon atoms inclusive (i.e., medium chain triglycerides or "MCT"). Suitable coating compositions can be obtained from Stepan Company (Northfield, Ill.). Preferred examples includes Neobee® M5 or Neobee® 1053, which are medium chain triglyceride mixtures having between about 98 to about 99 percent fatty acid residues with between 6 and 12 carbon atoms inclusive. These compositions further include about 32 to about 44 percent capric acid residues and about 55 to about 66 percent caprylic acid residues. However, the preferred MCT coating compositions may also include other glyceride mixtures including caproic, caprylic, capric, lauric acids residues, and/or mixtures thereof.

In another form, the coating 14 is a vegetable oil, such as olive oil, soybean oil, sunflower oil, canola oil and the like having a lipid soluble antioxidant blended therein. Suitable antioxidants include, but are not limited to, TBHQ, BHT, BHA, gallates, tocopherols, tocotrienols, ascorbyl palmiate, and mixtures thereof. It is expected that about 0.01 to about 0.5 percent antioxidant is suitable for the coating 14. In yet another form, the coating 14 may include mixtures of soybean or canola oil combined with small amounts of lecithin (i.e., about 20 percent or less) and food grade alcohols (i.e., about 20 percent or less). Such alternative coatings are expected to provide similar results when applied to a portion of the container side walls at room temperature, but are generally less desired in some cases because they may impart a slight color change to the product due to the tint of the base oils used for the coatings, or have other potential unwanted effects of the viscous material within the container.

Preferably, the predetermined coverage area 16 has about 3.5 mg/in$^2$ or less of the coating composition substantially uniformly applied thereto. In a particular example, such as when the container is between 18 and 24 fluid ounces, the predetermined coverage areas has about 0.15 to about 0.2 grams of the coating. Preferably, the coating composition is uniformly applied to the predetermined coverage area in a thickness of about 0.003 inches or less. Applying more coating 14 to the predetermined coverage area 16 is generally undesired because it is difficult to prevent the coating from spreading, flowing, or migrating to the uncoated portions.

Depending on the particular viscous product 12, such low amounts of the coating applied to less than the entire inner surfaces of the container is still sufficient to achieve product evacuation from the container during normal use of greater than about 90 percent, preferably greater than about 95 percent, and most preferably greater than about 98 percent at room temperature and also preferably at refrigeration temperatures. During evacuation, the viscous product generally slides of the coated portions and generally adheres to the uncoated portions. While preferred amounts of the coating are described above, it will be appreciated that different amounts may be applied depending on the particular size of the predetermined coverage area, the configuration, size, material, or shape of the container 10, and the characteristics of the viscous material.

Referring again to FIG. 1, with the container 10 having the coating 14 applied to the predetermined coverage area 16, the container has the coating applied along its side walls 28 a first distance or elevation 50. When the container 10 is filled with the viscous material 12, it is preferred to fill the cavity 32 to a second distance or elevation 52 that extends beyond the predetermined coverage area 16 or beyond distance 50, such as shown by the material fill distance 52 in FIG. 1. In this manner, the viscous material 12 contacts both the coated portions 20 and uncoated portions 22 of the container.

With such filling configuration, a head space 54 is formed between the viscous material upper surface 25 and the outlet portion opening 36. The headspace 54 is a portion of the cavity that is generally free of or not filled with the viscous material 12 (except for the thin layer of material 43 adhering to the uncoated portions). As illustrated, the headspace 54 includes portions of the transition portion 42 and the outlet portion 36; however, the cavity 32 may also be filled with more or less material 12 so that the headspace 54 comprises a larger or smaller volume. For example, the viscous material filling distance 52 may extend into the outlet portion 36 so that the headspace 54 may be confined just to the outlet portion 34 if so desired. As further shown in the Examples below, due to the uncoated regions 22, which generally have the layer 43 of viscous material 12 adhered thereto, the headspace 54 is able to substantially remain intact and not float around the container 10 even if the container 10 is repositioned, inverted, or placed on its side. While not wishing to be limited by theory, it is believed that the cohesiveness of the viscous material 12 and the lack of coating 14 on the inner surfaces 22 of the container adjacent the headspace 54 (which permits the layer 43 to substantially surround the headspace 54) allows the headspace 54 to remain stable relative to and adjacent the outlet portion 36 and not float around the container regardless of the orientation of the container. Consequently, even if the container 10 is inverted after filling, no visible void areas or bubbles are formed in the upper areas of the container 10 because the headspace 54 remains substantially constant relative to the opening 36 independent of container orientation.

Referring again to the figures, an exemplary method of applying the coating 14 to the predetermined coverage area 16 of the container 10 is illustrated. In general, the method includes (1) coating a predetermined coverage area of the interior of the container 10 up to the first elevation 50 with the coating, and (2) then filling the container 10 with the viscous product 12 to the second elevation 52 above the first elevation 50. The method is preferably configured to provide a commercially-viable, high-speed method to uniformly coat substantially only the predetermined coating area 16 of the container inner surfaces 36 with a relatively thin layer of a low-viscosity fluid or coating. The preferred methods allow the container inner surfaces to be coated through a relatively narrow container outlet portion (i.e., about 1 to about 5 inches wide, but other sizes are also suitable) with minimal, and preferably no contamination of the coating on the outside of the container or on unwanted portions of the inner surface (i.e., the uncoated portions 22) in a continuous and high speed manner. The method is advantageous because it provides for applying the coating only to a portion of the inner surfaces without requiring masking, blocking, or covering the unwanted container portions or applying an excess amount of the coating and allowing the excess coating to drain from the container.

Figure 2:
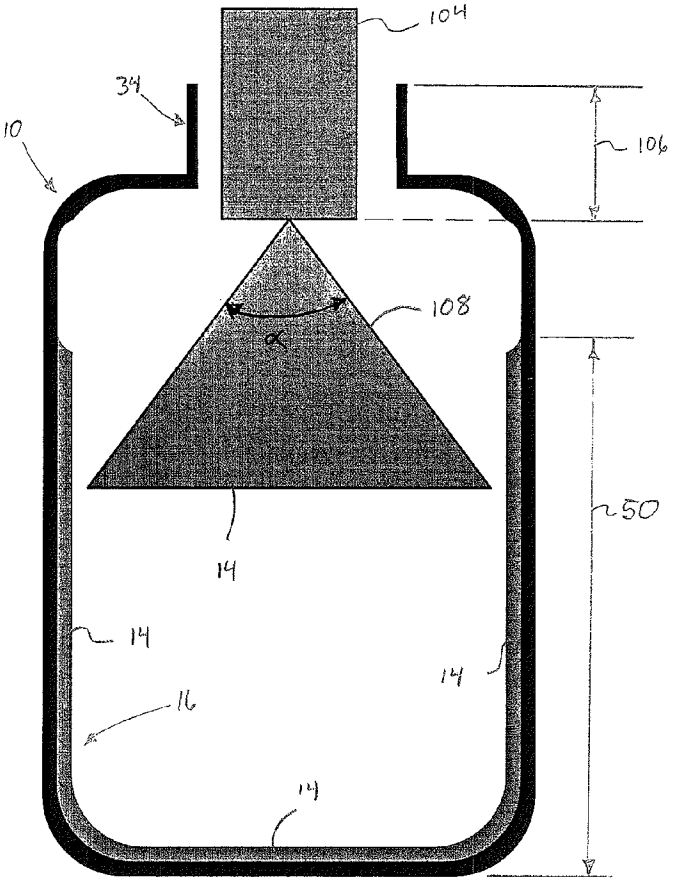
FIG. 2 is a schematic view of a exemplary spray nozzle applying the coating to the container inner surface.

Referring to FIG. 2, the predetermined coverage area 16 is preferably coated by spraying the coating 14 thereto. The spraying operation is arranged and configured to provide the coating composition to substantially only the predetermined coverage area and minimize, and preferably prevent coating from being applied to unintended areas. To this end, the method further includes inserting a spray nozzle 104 a predetermined distance 106 into the container 10 so that a single spray 108 of the coating composition is sufficient to apply the coating only to the predetermined coverage area 16. Preferably, the spray nozzle is inserted less than about 1.5 inches into the container, and preferably about 0.125 to about 1.5 inches into the container; however, the distance the spray nozzle 104 is inserted into the container 10 may vary depending on the container size/geometry, size of the outlet opening, and the configuration of the spray nozzle 104.

By one approach, the spray nozzle 104 is selected so that the spray pattern 108 has a predetermined spray field a that is configured to spray the coating 14 substantially only onto the predetermined coverage area 16 with substantially no coating outside the predetermined coverage area (i.e., uncoated areas 22 or container outer surfaces). By one preferred approach, the spray nozzle 104 has a nozzle configuration to project the spray pattern 108 with a spray field a less than about 60° to provide the coating only onto the predetermined coverage area 16. Preferably, the spray pattern 108 has a spray field a of about 15 to about 50°, and most preferably about 45°. Spray fields 108 greater than about 60° are undesired because they tend to apply the coating 14 to the entire inner surface area of the container. Suitable spray nozzles 104 may be obtained from Spraying Systems Company (Wheaton, Ill.) and include a twin fluid manifold with 1 channel for the fluid to be sprayed and between 2 and 8 air apertures (between 0.03 and 0.1 inches in diameter). Preferably, such nozzles spray about 2 to about 10 gph fluid using about 2 to about 20 psi air pressure.

By another approach, the method to apply the coating may further include coating the predetermined coverage area under a slight negative pressure sufficient to remove any residual coating from the interior of the container. The negative pressure is expected to evacuate any residual atomized coating from the atmosphere in the cavity to help minimize the coating from being applied to the unwanted areas. By one method, this negative pressure is achieved with a reverse airflow rate applied to the container of at least about 500 cfm and, preferably, about 800 to about 1000 cfm, which is sufficient airflow to evacuate any residual coating. Of course, other methods to achieve negative pressures may also be employed.

Figure 3:
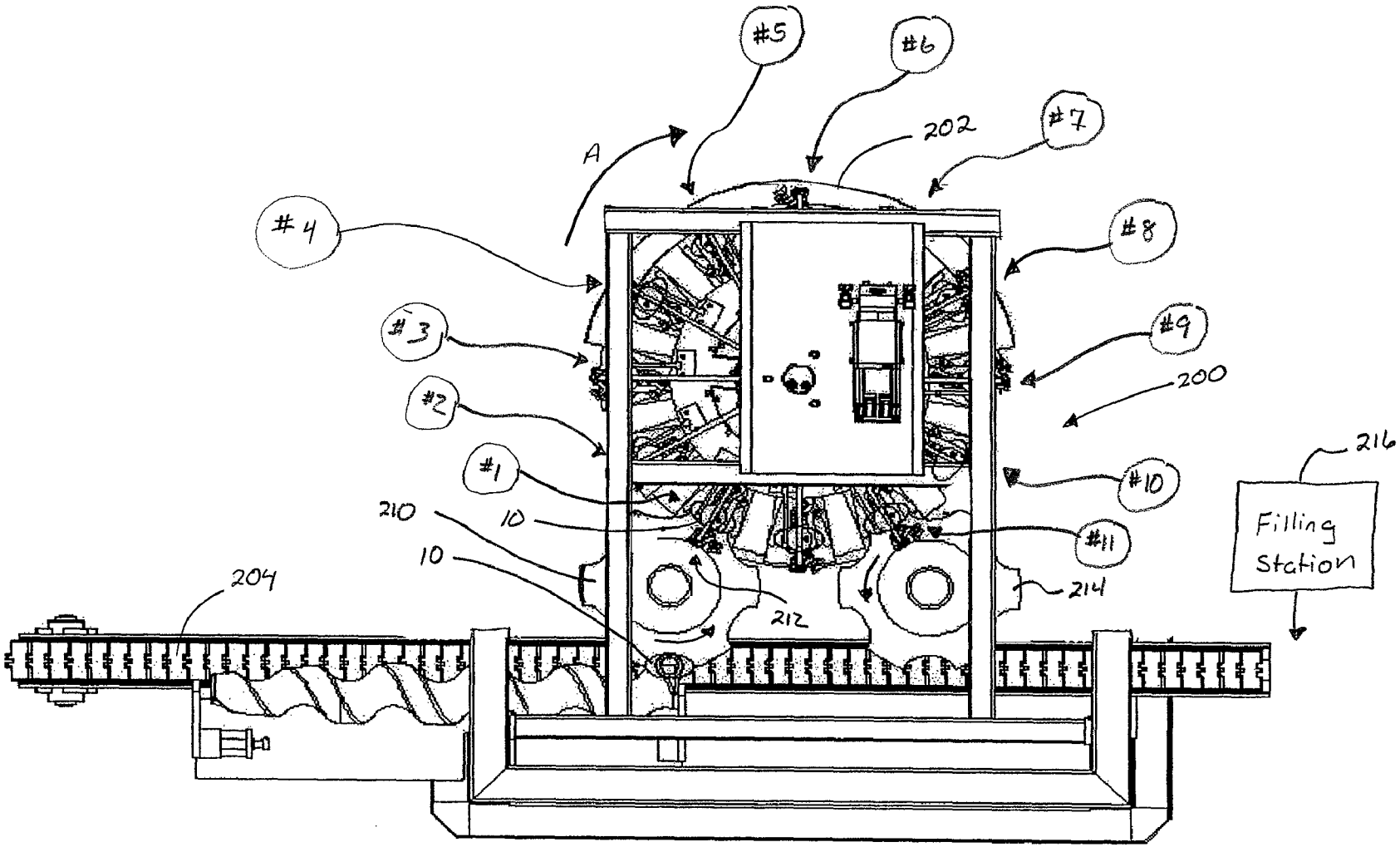
FIG. 3 is a plan view of an exemplary automatic spraying apparatus for applying the coating to inner surfaces of the container.
Figure 4:
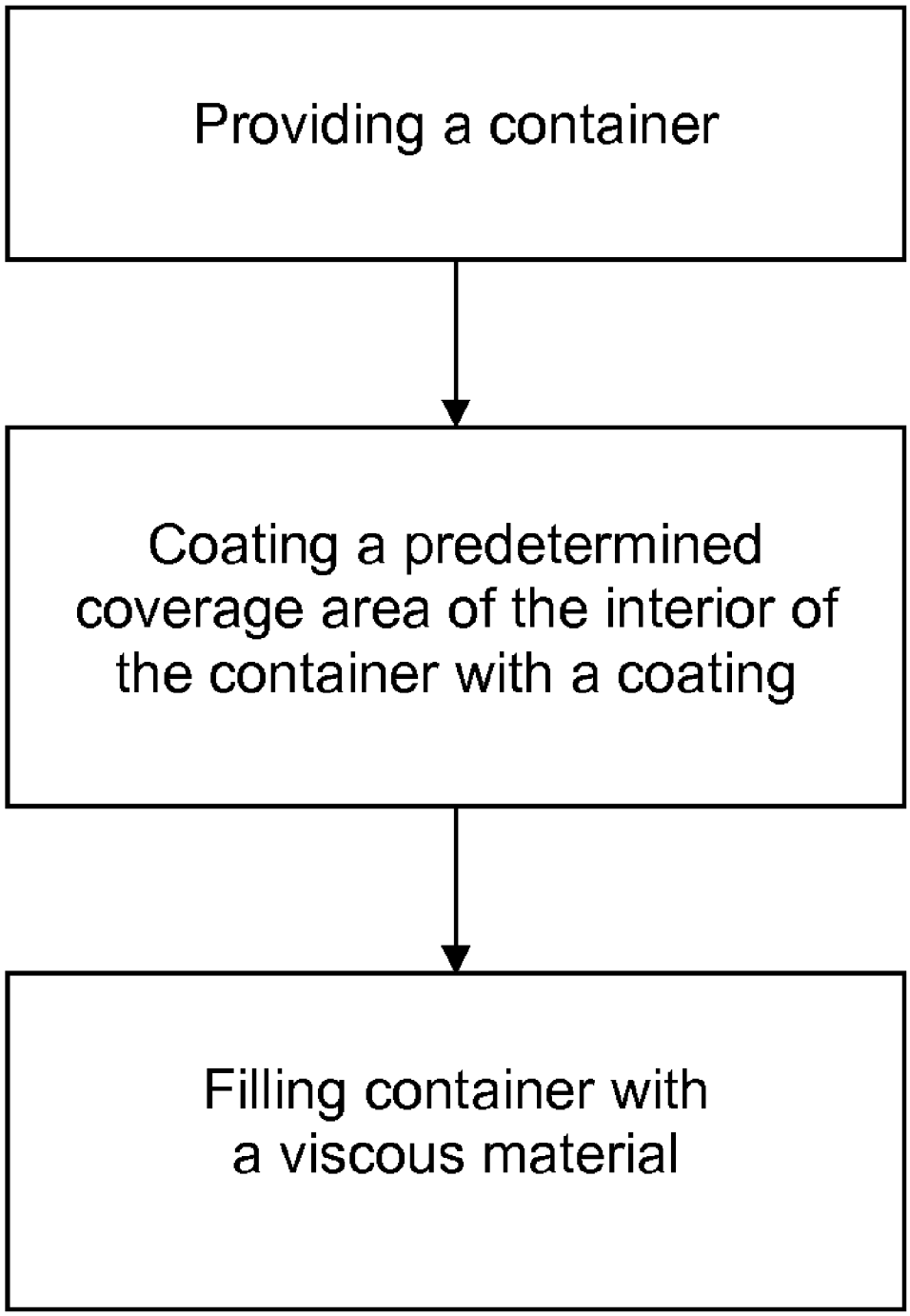
FIG. 4 is a flow chart of an exemplary method.

Turning to FIG. 3, one embodiment of a coating station 200 is illustrated in more detail. In this embodiment, the coating station 200 employs a rotary spindle 202 to transport and coat the containers 10 as they are rotated in the spindle 202. In this form, the coating station 202 requires a relatively small footprint in a manufacturing area and can be easily combined with a typical bottle filling line, such as at a side location along a common conveyor belt 204 prior to a filling station 216.

To retrieve the container, the coating station 200 includes a grabber spindle 210 (or other suitable transport device) that transports the empty and uncoated container 10 from the conveyor belt 204 into the spindle 202 at a receiving location 212 or rotary spindle position #1. As the spindle 202 is rotated (Arrow A), the container 10 is raised vertically into a spraying position as the container rotates through spindle positions #1, #2, and #3. By spindle position #3, the container has been raised a vertical distance so that the spray nozzle 104 is positioned the predetermined distance 106 within the container 10 (FIG. 2). In this manner, the spraying of the coating by the spray nozzle 10 is completely contained within the interior of the container to minimize overspray to unwanted areas. As the spindle 202 continues to rotate, the container 10 reaches spindle position #4 where the spraying of the coating is commenced. Preferably, the spraying is completed in a single burst or spritz of the coating composition before the container 10 reaches spindle position #5, where an additional spray or other application may be added to the container if desired. As the spindle 202 continues to rotate, the container 10 traverses spindle positions #6, #7, and #8 where the coating may be allowed to relax and generally adhere to the container side wall if needed. Optionally, spindle positions #6 to #8 may be used to apply additional coatings, materials, or substances into the container. Spindle positions #9, #10, and #11 are used to vertically lower the container 10 from the nozzle 104 so that a return grabber 214 (or other suitable transport device) may transport the container 10 from position #11 back to the conveyor belt 204 for further transport to the filling station 216 downstream of the coating station 200. While the rotary spindle 202 is illustrated with at least 11 discrete positions, the spindle 202 may have more or less positions as needed. While the coating station 200 is illustrated and described with various positions, it will be appreciated that these positions are only exemplary. It will also be appreciated that such positions need not be individual or discrete positions, but can be approximate locations along a continuously moving device or station. Preferably, the coating station 200 is sized to complement the desired production line speed to be attained.

The rotary spindle 202 has a number of positions that can be used for other purposes. For example, various positions can be used to evacuate or exhaust any coating mist from the atmosphere within the container or be used draw as much air as possible from the container prior to, during, or after activating the spray nozzle. It is anticipated that a container with air withdrawn from its cavity (i.e., generally at lower pressure or even in a vacuum) prior to coating may enable the spray nozzle to operate with less air pressure, spray with smaller sizes of coating droplets, and/or provide a more uniform coating to the coverage area 16.

While the above describes one method of applying the coating 14 to the predetermined coverage area 16. Other methods may also be possible, such as spraying the bottles in-line using multiple spray nozzles or other suitable container coating techniques. In addition, while a rotary operation is disclosed, other mechanisms and transport devices may be used to coat the containers.

The Examples that follow are intended to illustrate, and not to limit, the invention. All percentages used herein are by weight, unless otherwise indicated. All references cited herein are hereby incorporated by reference.

EXAMPLES

Example 1

The amount of residual product remaining in containers partially coated with a lipid composition (Containers A) was compared to the amount of residual product remaining in uncoated containers (Containers B). Each container was a plastic rectangular bottle made from PET approximately 7 inches high by 3 inches wide by 1.5 inches deep having about 18 fluid ounce capacity.

The lipid composition was a medium chain triglyceride (MCT) oil having about 99 percent medium chain fatty acid residues (Neobee 1053, Stepan Company, Northfield, Ill.). The lipid composition included about 55 percent caprylic acid residues and about 44 percent capric acid residues and had a viscosity of about 15.9 cp at 40° C., about 26 cp at 20° C., and about 61 cp at 5° C.

For the containers with the MCT coating (Containers A), about 20% of the inner surface extending down from the top opening was covered with masking tape to shield this inner surface. The inside of the containers was then sprayed with about 0.15 grams of the MCT oil using a spray nozzle (Spraying Systems, Wheaton, Ill.) to apply a very fine mist so that about 80 percent of the container (i.e., the unmasked portion) had the MCT coating thereon. The masking tape was then removed, and the containers were then filled using a piston-pump driven filler with either about 525 grams of Miracle Whip Light or about 475 grams of Kraft Real Mayonnaise (hereinafter "mayonnaise") (Kraft Foods, Northfield, Ill.) to an elevation above the coating. For the uncoated containers (Containers B), they were also filled with either about 525 grams of Miracle Whip Light or about 475 grams of Kraft Real Mayonnaise. In each case, the product was filled to approximately a constant volume. Both sets of containers were capped and then placed in a cardboard box and placed on a vibration table (Lansmont Corp, Manderville, Conn.) for approximately one hour to mimic vibrations encountered during shipping.

After the vibration tests, both container A and B were visually observed and the product evacuated by hand squeezing. After most of the product was evacuated by hand squeezing, the cap was closed and then the cap of the container was tapped on a surface to force any additional material into the outlet regions. The container was then again hand squeezed to empty any remaining material from the container. The amount of residual product was measured by comparing the weight of an evacuated container relative to the weight of a filled container. Results are provided in Table 1 below:

TABLE 1

| Container ID | Description | Visible Oil On Surface of Product | Volume Change | Residual Product after Evacuation |
|---|---|---|---|---|
| A | 80% coated with MCT Oil | None | No decrease in product volume | 2-5 percent |
| B (Control) | Uncoated | None | No decrease in product volume | 7-10 percent |

Example 2

The empty containers of Example 1 were coated using two different types of spray nozzles having different geometries of spray fields. The spray nozzles tested were Nozzle A, which provided a 45° spray field (Nozzle SUE-15-SS45, Spray Systems, Wheaton, Ill.) and Nozzle B, which provided a 60° spray field (Nozzle SU-HTE61d, Spray Systems, Wheaton, Ill.). Both nozzles were operated with an atomization air pressure at 5 psi and a fluid flow rate of about 2 gph. Each spray nozzle was inserted into the container about 10 percent of its height (i.e., about 0.7 inches), and about 0.15 grams of the MCT oil from Example 1 was sprayed into each container from the particular spray nozzle.

Each container was then filled with about 525 grams of Miracle Whip or about 475 grams of Miracle Whip Light (Kraft Foods, Northfield, Ill.) to an elevation above the coating and capped. In each case, the container was filled with approximately a constant volume of product. The samples were placed on a vibration table similar to Example 1 for about one hour. The samples were then visually observed. The results are shown in Table 2 below:

TABLE 2

| Container ID | Spray nozzle Type | Coverage of coating in Container | Observation After One Hour Vibration |
|---|---|---|---|
| C | Nozzle A | About 90% of distance up side wall and bottom wall | 80% of containers tested did not show any visible free oil or a visual decrease in the overall product volume. |
| D | Nozzle B | About 100% of container inner surfaces | All containers had visible free oil on the surface of the product and some decrease in overall product volume. |

Of the Containers C that showed some surface oil after vibration, only 2 of the containers with Miracle Whip showed slight oil on the product surface. It is believed that these containers exhibited slight surface oil due to under filling of Miracle Whip or variability in coating application so that the container exhibited behavior closer to a completely coated container.

Example 3

The evacuation performance of containers coated with MCT oil from Example 1 was compared to containers coated with soybean oil (Cargill, Minneapolis, Minn.) and containers with no coating (control). In this example, containers having a height of about 7 inches, a width of about 3.5 inches, and a depth of about 2.5 having about a 24 fluid ounce capacity were studied. For the coated containers, about 0.18 grams of each coating solution (either MCT oil or soybean oil) was applied as a very fine mist using a spray nozzle (Spraying Systems, Wheaton, Ill.) to the entire inner surface of empty containers to achieved nearly 100 percent coating of the container inner surfaces. Then, about 720 grams of Miracle Whip was added to each container (MCT coated, soybean oil coated, and no coating) using a piston-pump driven filler.

The contents of each container was then emptied through squeezing and tapping the bottles onto a table to force the maximum amount of product out of the container as described in Example 1. Each container was weighed full and after being emptied to determine the residual amount of product remaining. Results are provided in Table 3 below:

TABLE 3

| Containers ID | Coating | Residual Product After Evacuation |
|---|---|---|
| F | ~100% MCT Oil | 1.5% |
| F | ~100% Soybean Oil | 4.6% |
| G | No coating | 7.8% |

Example 4

Filled containers A and C from Examples 1 and 2, which only included a portion of its inner surface coated with MCT oil, were compared with an empty container from Example 1 having 100 percent of its inner surface coated with Neobee 1053 (Stepan, Northfield, Ill.) (Container H). Container A was filled with mayonnaise and the Container C was filled with Miracle Whip. Container H was filled with a similar amount of mayonnaise. Each container was filled with a similar product volume. Each container was originally filled in an upright position and then capped so as to form a headspace of empty product between the top surface of the material and the cap when in the upright position. Thereafter, each container was inverted into a cap down position to study the ability to maintain the original position of the headspace adjacent the cap.

Figure 6:
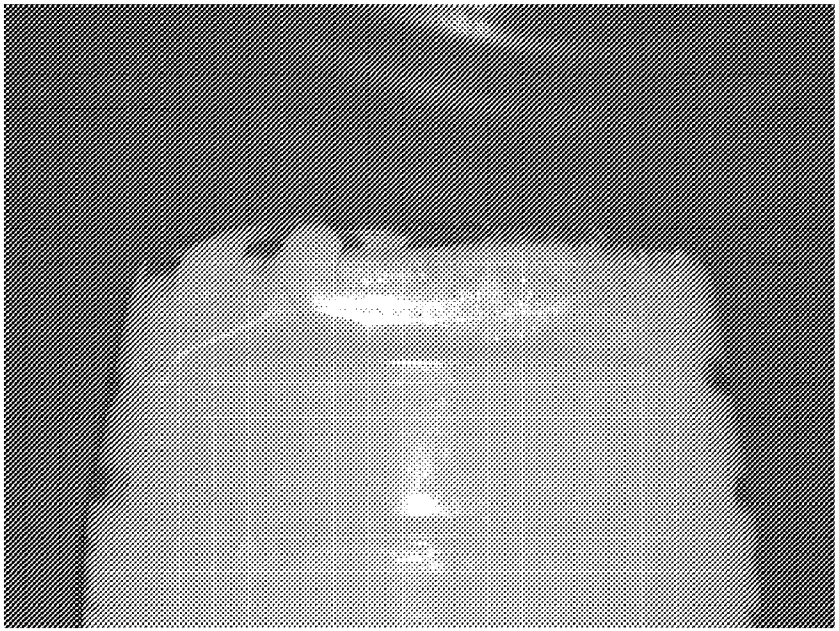
FIGS. 5 and 6 are photographs of a 18 fluid ounce container having nearly 100 percent of its inner surface coated with a medium chain lipid composition, filled with mayonnaise, and inverted.
Figure 5:
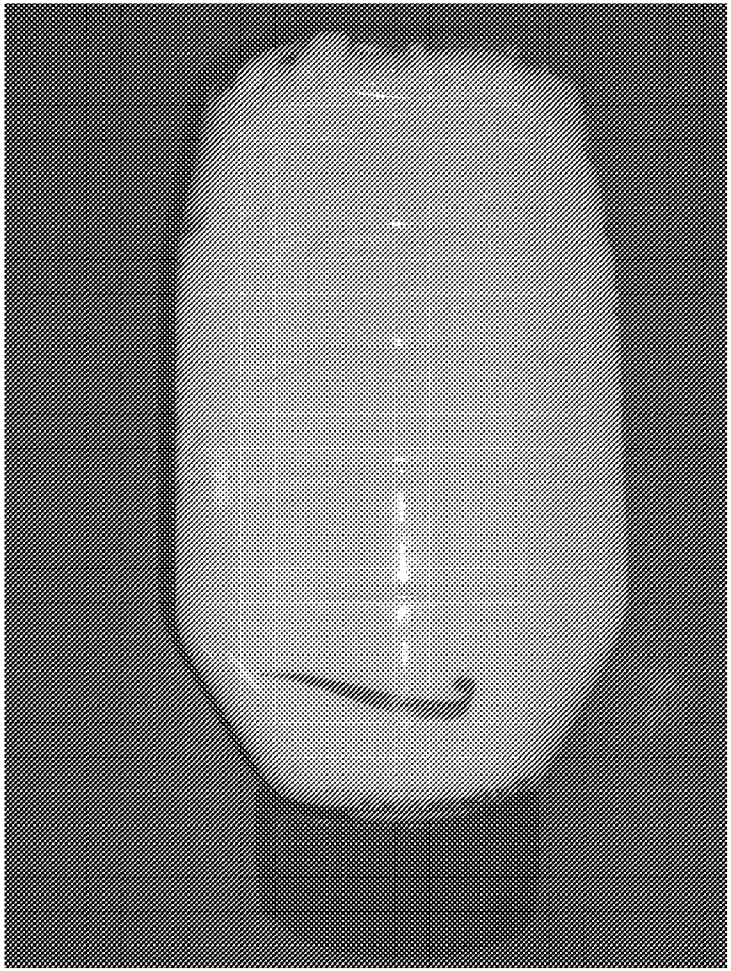
Figure 8:
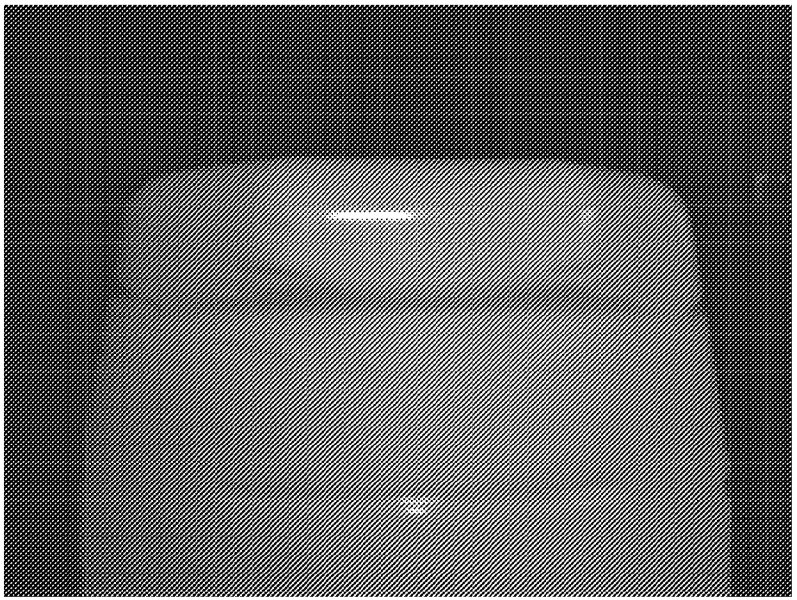
FIGS. 7 and 8 are photographs of a 18 fluid ounce container having only a portion of its inner surfaces coated with a medium chain lipid composition via a spray nozzle having about a 45° spray field, filled with Miracle Whip, and inverted.
Figure 7:
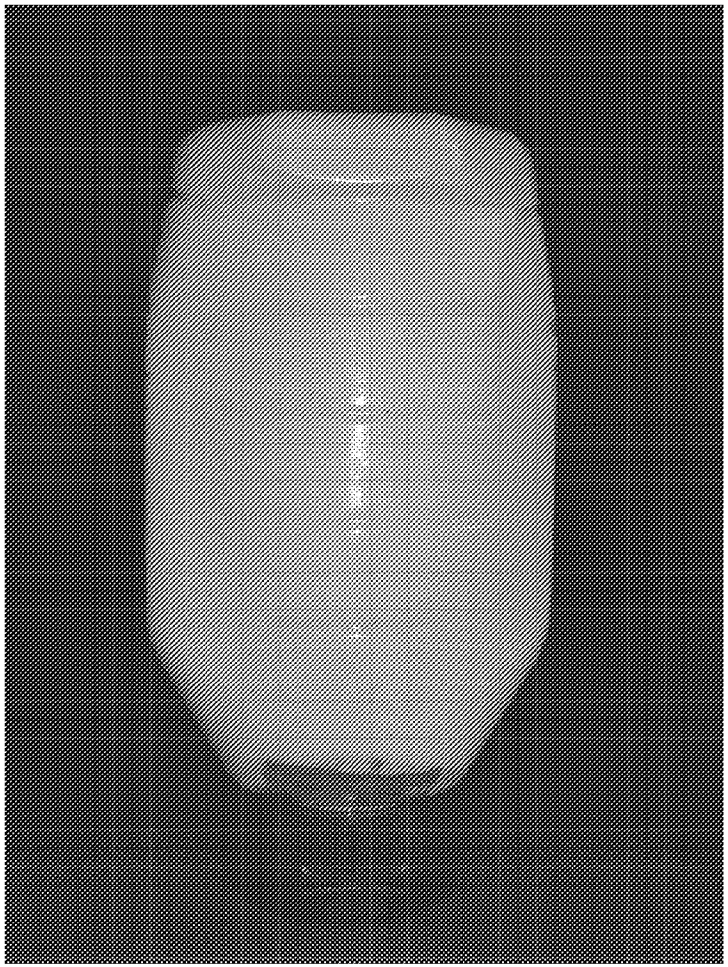
Figure 10:
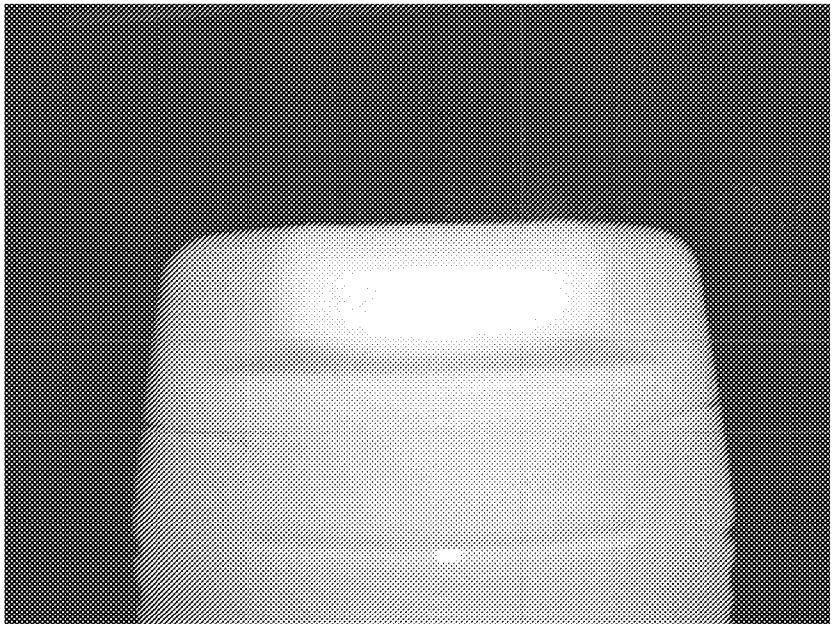
FIGS. 9 and 10 are photographs of a 18 fluid ounce container having only a portion of their inner surfaces coated with a medium chain lipid composition by shielding portions of the container adjacent the opening, filled with mayonnaise, and inverted.
Figure 9:
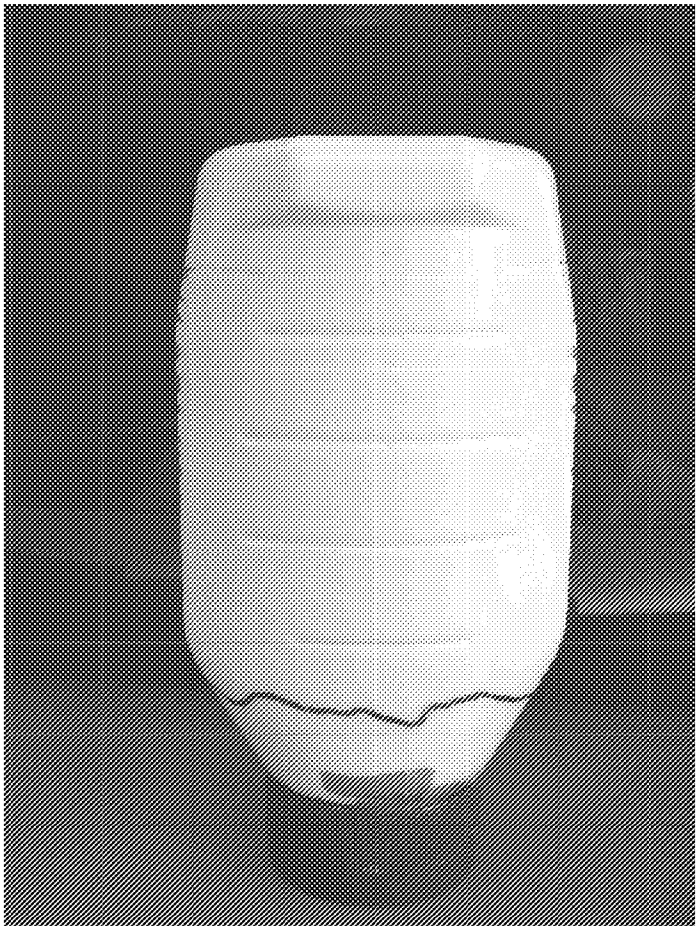

As shown in FIGS. 5 and 6, Container H (100% coating) when inverted to a cap down position, formed bubbles on the upper portions of the container indicating that container H could not maintain the original positioning of the headspace, which floated from adjacent the cap to other portions of the container. These containers would not be as desirable to a consumer. As shown in FIGS. 7 to 10, Containers A and C (partially coated) were able to maintain the positioning of the headspace adjacent the cap and not form any bubbles or void areas at the opposite and now upper portions of the container.

Example 5

The study of Example 4 was repeated using a 24 fluid ounce capacity container. In this example, plastic, generally rectangular shaped containers with dimensions of approximately about 7 inches high by about 3.5 wide by about 2.5 deep were used. Similar results were obtained as in Example 4 regarding the ability of the containers to maintain the positioning of the headspace.

Figure 12:
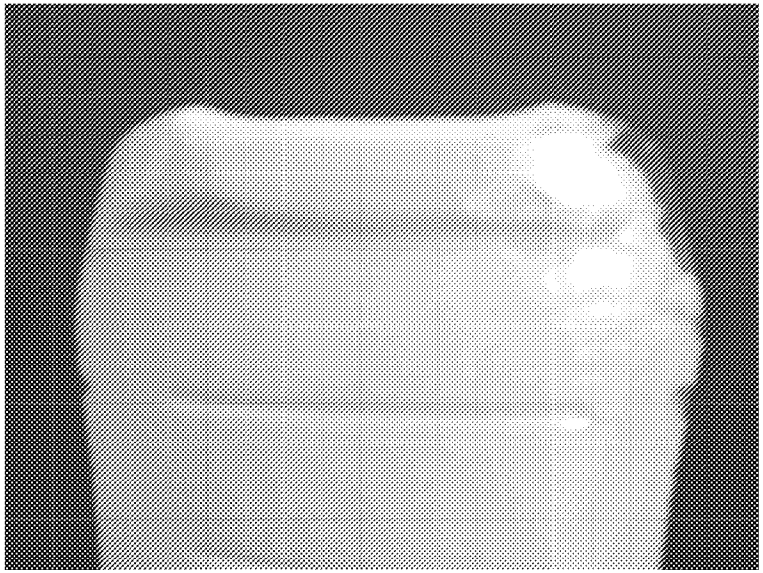
FIGS. 11 and 12 are photographs of a 24 fluid ounce container having nearly 100 percent of its inner surface coated with a medium chain lipid composition, filled with mayonnaise, and inverted.
Figure 11:
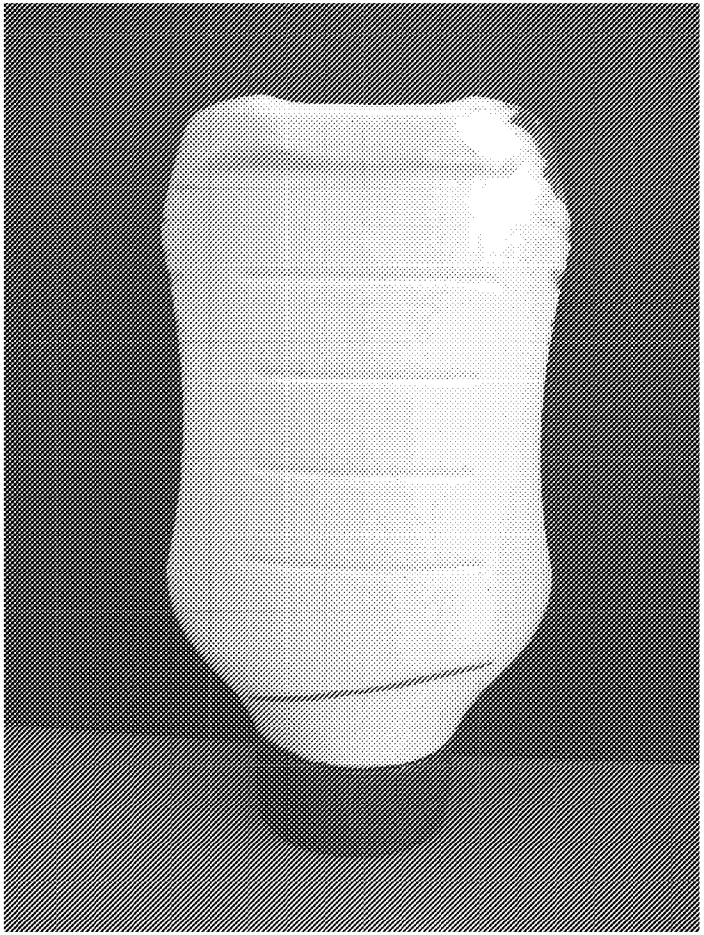
Figure 14:
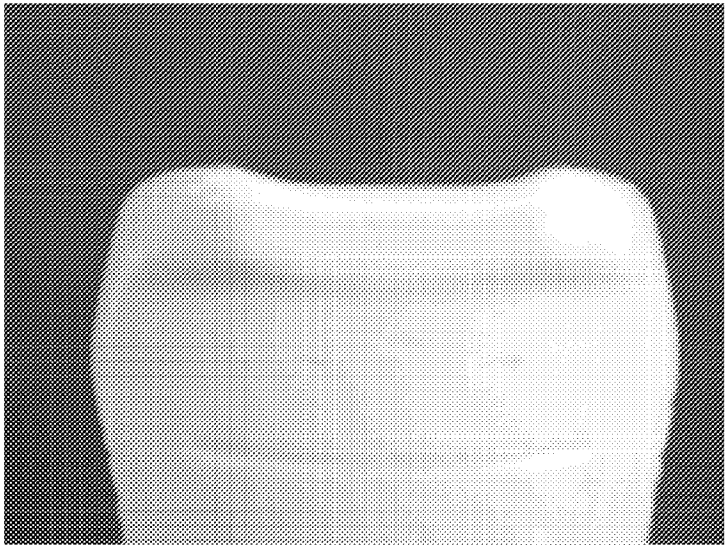
FIGS. 13 and 14 are photographs of a 24 fluid ounce container having only a portion of its inner surfaces coated with a medium chain lipid composition via a spray nozzle having about a 45° spray field, filled with mayonnaise, and inverted.
Figure 13:
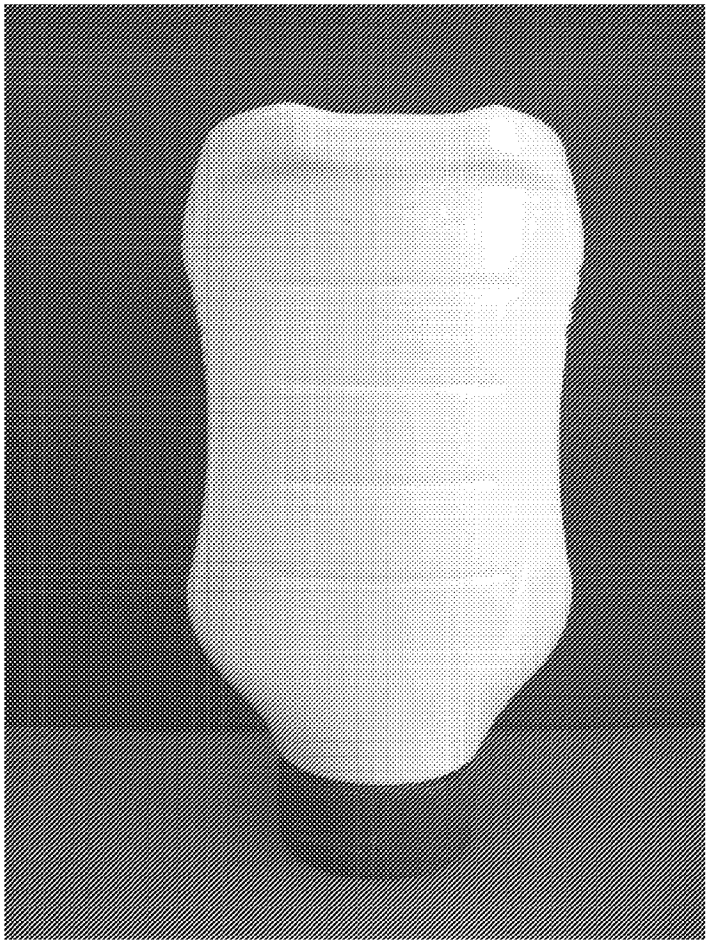

As shown in FIGS. 11 and 12, a 24 ounce container coated 100 percent with Neobee 1053 (Stepan, Northbrook, Ill.) and filled with mayonnaise when inverted had bubbles and void areas formed at the upper surfaces of the cavity indicating that the headspace had floated about the container cavity (Container I). On the other hand, as shown in FIGS. 13 and 14, the 24 ounce container with mayonnaise and only partial coating with Neobee 1053 to the inner surfaces exhibited no movement of the headspace and no void areas or bubbles in the cavity upper surfaces when the container was inverted (Container I).

Accordingly, Examples 4 and 5 demonstrate the ability of a partially coated container to maintain the original position of the headspace relative to the outlet independent of container geometry and independent of container orientation. Containers coated on their entire inner surfaces do not exhibit such behavior.

Example 6

Containers A and C from Examples 1 and 2 were packed in cardboard boxes, stacked on a wooden pallet and shipped approximately 2000 miles in a semi-truck over about 4 days. At the end of the trip, the samples were visually inspected. Upon visual inspection, there were no signs of oiling off nor were there any noticeable increase in headspace in the top of the container.

Example 7

A variety of different coating oils were tested to compare the amount of residual product left in the container after normal use compared to the MCT oil from Example 1. Three empty containers of Example 1 were each sprayed on the interior with about 0.3 grams of the oils listed in Table 4 to coat about 100% of the container inner surfaces. The containers were sprayed using a Misto® spray bottle. The coated containers were then filled with about 475 grams of mayonnaise and then stored at room temperature for three days. The product was evacuated using the procedure of Example 1. The containers were weighed before and after evacuation to determine the amount of residual product remaining.

TABLE 4

Evacuation Performance at Room Temperatures

| Coating Composition | Average Amount of product remaining in 3 containers | Evacuation Improvement from Control |
|---|---|---|
| Control-No Coating | 7.9% | — |
| Extra Virgin Olive Oil | 6.1% | −23.4% |
| Extra Light Olive Oil | 5.7% | −28.0% |
| Canola Oil | 7.5% | −5.3% |
| Soybean Oil | 5.7% | −29.0% |
| Sunflower Oil | 6.7% | −15.3% |
| Peanut Oil | 6.6% | −17.8% |
| Corn Oil | 5.4% | −31.7% |
| MCT Oil | 4.0% | −49.6% |

Example 8

For comparison purposes, the apparent viscosities of the coatings of Table 4 above were measured at both refrigeration temperatures (about 5° C.) and at room temperatures (about 20° C.). The viscosity was measured using a Brookfield viscometer Model RVDV-11+ using a spindle #21 at 50 RPM. The results are listed in Table 5 below.

TABLE 5

Viscosity Comparison

| Coating Composition | 5° C. | 20° C. |
|---|---|---|
| Control-No Coating | — | — |
| Extra Virgin Olive Oil | 565 | 61 |
| Extra Light Olive Oil | 334 | 61 |
| Canola Oil | 148 | 57 |
| Soybean Oil | 122 | 51 |
| Sunflower Oil | 127 | 46 |
| Peanut Oil | 624 | 59 |
| Corn Oil | 130 | 47 |
| Neobee 1053 MCT | 61 | 26 |

Example 9

The evacuation performance of containers coated with the MCT coating of Example 1 was compared to containers coated with soybean oil (Cargill, Minneapolis, Minn.) and containers with no coating (control) at refrigeration temperatures (about 5° C.). Containers having a capacity of either 24 oz (7 inches high, 3.5 inches wide, and 2.5 inches deep) or 18 fluid ounces (7 inches high, 3 inches wide, and 1.5 inches deep) were coated on their entire inner surfaces with either the MCT coating or soybean oil as shown in Table 6 below. The containers were filled either with Miracle Whip or mayonnaise (to achieve consistent product volumes) and then stored for one week in a refrigerator at 5° C. The samples were weighed and then evacuated using the procedures of Example 1. The containers were reweighed to determine the amount of residual product left in the container. Results are provided in Table 6 below.

TABLE 6

Evacuation at Refrigeration Temperatures

| Product | Container Size | Coating | Amount of Coating, grams | Average Amount of product remaining in 3 containers after evacuation | Evacuation Difference from Control |
|---|---|---|---|---|---|
| Miracle Whip | 24 oz | Control | 0 | 7.6% | — |
| Miracle Whip | 24 oz | Soybean Oil | 0.18 | 6.3% | −17% |
| Miracle Whip | 24 oz | Neobee 1053 | 0.18 | 1.1% | −85% |
| Mayonnaise | 24 oz | Control | 0 | 6.4% | — |
| Mayonnaise | 24 oz | Soybean Oil | 0.18 | 4.7% | −26% |
| Mayonnaise | 24 oz | Neobee 1053 | 0.18 | 3.6% | −44% |
| Miracle Whip | 18 oz | Control | 0 | 7.0% | — |
| Miracle Whip | 18 oz | Soybean Oil | 0.15 | 6.6% | −6% |
| Miracle Whip | 18 oz | Neobee 1053 | 0.15 | 2.0% | −71% |
| Mayonnaise | 18 oz | Control | 0 | 6.0% | — |
| Mayonnaise | 18 oz | Soybean Oil | 0.15 | 5.6% | −7% |
| Mayonnaise | 18 oz | Neobee 1053 | 0.15 | 3.9% | −35% |

Comparative Example 10

The impact of coating the entire interior of a container sprayed with an atomized lipid system on the physical stability of an oil-in-water emulsion was studied using automatic filling of a container. Empty containers from Example 1 were sprayed with about 0.15 grams of a very fine oil mist of either soybean oil (Cargill) or Neobee 1053 MCT (Stepan) using a nozzle located at the top of the container. From this process, nearly 100 percent coating was achieved. These coated containers then were filled with a piston-pump driven filler with slightly aerated Miracle Whip and capped. An uncoated control was also filled with Miracle Whip in a similar manner. These samples were then placed in a cardboard box and placed on a vibration table for approximately one hour to mimic vibrations encountered during shipping. Upon visual inspection, there was an amount of visible free oil (approximately 5 mL of oil) localized around the neck and shoulder of the container and while the product maintained it's white appearance, there was a noticeable increase in headspace in the top of the container—an indication of loss of overrun within the product or collapse of the product. Both coatings when applied to nearly 100 percent of the container exhibited and increase in headspace. The uncoated control, exhibited no change in headspace or noticeable surface oil.

It will be understood that various changes in the details, materials, and arrangements of the container, the formulations, and ingredients, which have been herein described and illustrated in order to explain the nature of the container and method, may be made by those skilled in the art within the principle and scope of the embodied method as expressed in the appended claims.

What is claimed is:

1. A container comprising:

at least one side wall defining a cavity, the at least one side wall having an inner surface;

an outlet portion defining an opening into the cavity;

a coating applied to a lower portion of the at least one side wall inner surface, the coating being effective to permit increased evacuation of a viscous substance from the container relative to a container without the coating; and an upper portion of the side wall and the outlet portion substantially free of the coating with less than about 0.3 mg/in$^2$ of the coating thereon such that, when the cavity is filled with a viscous substance to a height above the lower portion, the viscous substance adheres to the inner surface of the at least one side wall upper portion that is substantially free of the coating and does not adhere to the lower portion of the side wall having the coating thereon.

2. The container of claim 1, wherein the the at least one side wall has a height and the coating is applied to about 70 to about 90 percent of the height.

3. The container of claim 2, wherein the height is greater than a container width.

4. The container of claim 1, wherein the container includes a transition portion extending between the at least one side wall and the outlet portion, the transition portion substantially free of the coating with less than about 0.3 mg/in$^2$ of the coating thereon such that, when the coating is filled with the viscous substance to a height above the lower portion, the viscous substance adheres to an inner surface of the transition portion.

5. The container of claim 1, wherein about 3.5 mg/in$^2$ or less of the coating is applied to the lower inner surface of the container.

6. The container of claim 1, wherein the coating has a thickness of about 0.003 inches or less.

7. The container of claim 1, wherein the coating has a viscosity of less than about 25 cp at room temperature.

8. The container of claim 7, wherein the coating has a viscosity of less than about 60 cp at refrigeration temperatures.

9. The container of claim 1, wherein the coating is a lipid composition comprising glycerol esters having about 70 to about 100 percent fatty acid residues between 6 and 12 carbon atoms inclusive.

10. The container of claim 1, wherein the coating is a vegetable oil comprising a soluble antioxidant selected from the group consisting of TBHQ, BHT, BHA, gallates, tocopherols, tocotrienols, ascorbyl palmiate, and mixtures thereof.

11. The container of claim 1, wherein the viscous substance is selected from the group consisting of mayonnaise, salad dressing, sauces, lotions, spreads, and pastes.

12. The container of claim 1, wherein the cavity has a volume of at least about 5 fluid ounces.

13. The container of claim 1, wherein the cavity has a volume of at least about 18 fluid ounces.

14. A container for holding a viscous substance, the container comprising:

a holding portion with at least one side wall defining a cavity, the at least one side wall having an inner surface; and about 3.5 mg/in$^2$ or less of a coating applied to less than the entire inner surface of the at least one side wall up to a first elevation so that a lower portion of the side wall has the coating thereon and an upper portion of the side wall is substantially free of the coating with less than about 0.3 mg/in$^2$ of the coating thereon so that with a viscous substance in the cavity above the first elevation, the viscous substance adheres to an inner surface of the side wall upper portion that is substantially free of the coating and does not adhere to the lower portion of the side wall having the coating thereon.

15. The container of claim 14, wherein the coating has a viscosity of about 60 cp or less at refrigeration temperatures.

16. The container of claim 14, wherein the coating is a triglyceride mixture having about 70 to about 100 percent fatty acid residues between 6 and 12 carbon atoms inclusive.

17. The container of claim 14, further comprising a substance in the container with a viscosity greater than about 5,000 cp in the cavity above the first elevation so that the substance adheres to the inner surface of the the at least one side wall upper portion.

18. The container of claim 14, further comprising an outlet defining an opening to the cavity and wherein an inner surface of the outlet is substantially free of the coating with less than about 0.3 mg/int of the coating thereon such that the viscous substance adheres to the inner surface of the outlet.

19. The container of claim 18, wherein a head space between a surface of the viscous substance and the outlet remains adjacent the outlet independent of an orientation of the container between filling of the container and use thereof by a consumer.

20. The container of claim 14, wherein the coating has a thickness of about 0.003 inches or less.

21. The container of claim 14, further comprising a hand pump.

22. A filled container comprising:

a side wall having an inner surface defining a cavity;

a viscous substance in the cavity;

an outlet for dispensing the viscous substance from the cavity;

a first portion of the side wall inner surface having a coating applied thereon up to a first elevation;

a second portion of the side wall inner surface adjacent the dispensing outlet substantially uncoated free of the coating with less than about 0.3 mg/in$^2$ of the coating thereon; and an amount of the viscous substance in the cavity filled to a second elevation above the first elevation so that the viscous substance does not adhere to the first side wall portion having the coating thereon but adheres to the second side wall portion substantially free of the coating.

23. The filled container of claim 22, wherein the substance has a viscosity of greater than about 5,000 cp.

24. The filled container of claim 22, wherein the coating is about 3.5 mg/in$^2$ or less of a fatty acid composition having a viscosity less than about 25 cp at room temperature and less than about 60 cp at refrigeration temperatures.

25. The filled container of claim 24, wherein the fatty acid composition is a triglyceride having about 70 to about 100 percent saturated fatty acid residues between 6 and 12 carbon atoms inclusive.

26. The filled container of claim 22, wherein over 90 percent of the viscous substance may be evacuated during normal use without insertion of a utensil into the filled container.

27. The filled container of claim 22, wherein over 95 percent of the viscous substance may be evacuated during normal use with out insertion of a utensil into the filled container.

28. The filled container of claim 22, wherein the filled container prior to the evacuation of the viscous substance includes a headspace between a surface of the viscous substance and the outlet, and the headspace remains adjacent to the outlet independent of an orientation of the container.

29. The filled container of claim 22, wherein an amount of the viscous substance in the cavity covers the first portion of the interior inner surface and at least a portion of the second portions of the interior inner surface.

30. The filled container of claim 22, further comprising a hand pump.

* * * * *

UNITED STATES PATENT AND TRADEMARK OFFICE

CERTIFICATE OF CORRECTION

PATENT NO. : 8,003,178 B2
APPLICATION NO. : 11/748815
DATED : August 23, 2011
INVENTOR(S) : Dennis Ann Kim, Mia Rivard and Jeffrey Donald Edgerton It is certified that error appears in the above-identified patent and that said Letters Patent is hereby corrected as shown below:

Column 17, line 41, in claim 2, after “wherein” delete the first instance of “the”.

Column 18, line 4, in claim 10, delete “palmiate” and insert --palmitate-- therefor.

Column 18, line 38, in claim 17, after “inner surface of” delete the first instance of “the”.

Column 18, line 43, in claim 18, delete “0.3 mg/int” and insert --0.3mg/in2-- therefor.

Column 18, line 62, in claim 22, after “substantially” delete “uncoated”.

Column 20, line 3, in claim 27, delete “with out” and insert --without-- therefor.

Signed and Sealed this
Twenty-ninth Day of November, 2011

David J. Kappos

David J. Kappos
*Director of the United States Patent and Trademark Office*